US012072151B2

(12) United States Patent
Singh et al.

(10) Patent No.: US 12,072,151 B2
(45) Date of Patent: Aug. 27, 2024

(54) INDUCED DRAFT AIR-COOLED CONDENSER SYSTEM

(71) Applicant: HOLTEC INTERNATIONAL, Camden, NJ (US)

(72) Inventors: Krishna P. Singh, Jupiter, FL (US); Akhilesh Vidyutkumar Bapat, Evesham, NJ (US); Vytautas Vincas Maciunas, Cherry Hill, NJ (US); Raghavendra Palle, Camden, NJ (US)

(73) Assignee: HOLTEC INTERNATIONAL

( * ) Notice: Subject to any disclaimer, the term of this patent is extended or adjusted under 35 U.S.C. 154(b) by 567 days.

(21) Appl. No.: 17/193,536

(22) Filed: Mar. 5, 2021

(65) Prior Publication Data

US 2021/0278134 A1 Sep. 9, 2021

Related U.S. Application Data

(60) Provisional application No. 62/986,401, filed on Mar. 6, 2020.

(51) Int. Cl.
*F28B 1/06* (2006.01)

(52) U.S. Cl.
CPC ..... *F28B 1/06* (2013.01)

(58) Field of Classification Search
CPC ..... F28B 1/06
USPC ..... 165/122
See application file for complete search history.

(56) References Cited

U.S. PATENT DOCUMENTS 3,384,165 A * 5/1968 Mathews ..... F28D 5/02 D23/314
3,703,592 A 11/1972 Kassat et al.
4,149,588 A 4/1979 Waters
8,104,746 B2 * 1/2012 Wiltz ..... F28C 1/02 261/DIG. 11
8,186,152 B2 * 5/2012 Zhang ..... F01D 25/30 60/299
8,425,223 B2 * 4/2013 Zhang ..... F02C 6/18 431/11
D693,447 S * 11/2013 Tanno ..... D23/314
(Continued)

OTHER PUBLICATIONS

International Search Report and Written Opinion for International Application No. PCT/US2021/021089 mailed on May 25, 2021.

*Primary Examiner* — Claire E Rojohn, III
(74) *Attorney, Agent, or Firm* — The Belles Group, P.C.

(57) ABSTRACT

An induced draft air-cooled condenser for steam condensing applications includes a pair of inclined tube bundles defining a interior space therebetween in fluid communication with ambient air heated as it flows through the tube bundles. A fan supported above the interior space comprises rotatable fan blades disposed inside a cylindrical annular fan shroud. A drive mechanism operable to rotate the fan blades includes a motor operably coupled to the fan blades. The motor is supported inside the fan shroud and may be housed in a protective enclosure which may be insulated. A motor cooling system includes an air inlet duct fluidly coupled to ambient air outside the shroud and the enclosure. When the fan operates, cool ambient air is drawn via a vacuum formed by the fan through the duct to cool the motor. The air thus bypasses and is not heated by the tube bundles.

19 Claims, 20 Drawing Sheets

(56) References Cited

U.S. PATENT DOCUMENTS

| | | | | |
|---|---|---|---|---|
| 8,596,073 | B2 * | 12/2013 | Zhang | F01N 3/043 60/39.5 |
| 8,707,699 | B2 * | 4/2014 | Badin | F28D 1/04 60/645 |
| 9,335,098 | B2 * | 5/2016 | Pawlick | F28D 1/024 |
| 9,995,182 | B2 * | 6/2018 | Scholz | F28B 1/06 |
| 10,031,535 | B2 * | 7/2018 | Rollins | F04D 27/002 |
| 2002/0005176 | A1 | 1/2002 | Bensing et al. | |
| 2012/0222832 | A1 | 9/2012 | Rollins et al. | |
| 2015/0027679 | A1 | 1/2015 | Singh et al. | |
| 2017/0051980 | A1 | 2/2017 | Singh et al. | |
| 2019/0093953 | A1 | 3/2019 | Singh | |
| 2019/0242660 | A1 * | 8/2019 | Badin | F28B 1/06 |
| 2020/0318909 | A1 | 10/2020 | Singh et al. | |

* cited by examiner

INDUCED DRAFT AIR-COOLED CONDENSER SYSTEM

CROSS-REFERENCE TO RELATED APPLICATIONS

The present application claims the benefit of priority to U.S. Provisional Application No. 62/986,401 filed Mar. 6, 2020; the entirety of which is incorporated herein by reference.

BACKGROUND

The present invention generally relates to dry cooling systems, and more particularly to an induced draft air-cooled condenser system suitable for steam condensing applications in a Rankine cycle of an electric generating power plant or other non-power generating applications.

An air-cooled condenser (ACC) provides a competent alternative to the water-cooled condenser to condense large quantities of low pressure waste steam from power plants and other industrial installations. The induced draft air cooled condenser (IDACC) is characterized by the fan located above a pair of inclined tube bundles. The angle of inclination of the tubes is typically about 60 degrees from the horizontal plane. The fan draws ambient air through the tube bundles to condense steam flowing therein and thus provides a heat sink. Thus, the air stream drawn inwards into the interior space between the inclined tube bundles beneath by the fan is heated before reaching the fan.

The temperature rise in a typical IDACC created by ambient air flowing through the tube bundles may be as high as 70 degrees F. above the ambient air temperature. While the fan structure and gear box (housing the gear train coupled to the fan shaft) can handle such elevated air temperatures without difficulty, the fan motor (prime mover) is often not capable of withstanding sustained flow of hot air over a period of time without operational problems and damage. To deal with this problem in the current state-of-the art, the motor is typically located outside the annular fan stack or shroud and the rising air stream within the interior space of the IDACC. The motor is mechanically connected to the gear train through a long motor shaft, often as much as 20 feet or longer. Besides adding a major maintenance item to the system, such a long shaft exposed to the shifting ambient conditions and heated rising airstream presents a concern for long term reliability. The metal shafts may warp over time which in turn may lead to damage of the motor bearings at a minimum and potentially the drive gear train in the gear box coupled to the motor shaft.

An improved induced draft air-cooled condenser which overcomes the foregoing drawbacks is therefore desired.

SUMMARY

An induced draft air-cooled condenser (IDACC) system according to the present disclosure provides a novel fan drive system configuration as an alternative to the foregoing long motor drive shaft and concomitant drawbacks described above. The present approach disclosed herein further provides an economical solution which takes advantage of the airflow dynamics through the air-cooled condenser to eliminate the problems of the past.

In one embodiment, the fan motor may be located inside the annular fan shroud of the axial flow fan in close proximity to the fan gear drive or train, thereby allowing a relatively short motor shaft to be used unlike the 20 foot or longer shafts of the past. To protect the fan motor from the high temperatures encountered by locating the fan within the rising heated airstream path of the interior space of the IDACC after passing through the tube bundles, the motor is located inside a metal insulated protective enclosure. The motor protective enclosure has one side which comprises a cooling air inlet coupled to a cooling air inlet duct which extends laterally outwards through the fan shroud and is in fluid communication with unheated cool ambient air external to the tube bundles. The duct may be insulated. An opposite side of the motor protective enclosure to the air inlet duct side is open to the interior space between the tube bundles of the IDACC. As the heated air is drawn upward past the open side of the enclosure by the rotating fan blades located above the motor, a negative pressure or vacuum is created inside the fan shroud beneath the blades and particularly motor enclosure by the motive force of the fan. The air inlet duct acts as a snorkel which draws ambient cooling air outside the fan shroud through the motor protective enclosure and outwards through the open side of the enclosure into the interior space of the IDACC where the cooling air mixes with the heated rising airstream. This advantageously continuously cools the motor via a siphon effect for as long as the fan and IDACC are operating without the need normally for any additional blowers or fans to cool the motor or power consumption. In the event the rising airstream were to be extremely hot such that the natural thermosiphon vacuum effect might not sufficiently cool the motor alone, however, a cooling air booster blower could be fluidly coupled to the air inlet conduit outside the fan shroud to increase the cooling air flow rate (e.g. CFM) to the fan motor. This latter embodiment still obviates the need for the extremely long fan drive shafts of the past.

In one aspect, an induced draft air-cooled condenser comprises: a vertical centerline axis; a support structure; a pair of inclined tube bundles supported by the support structure, the tube bundles each comprising a plurality of tubes; the tube bundles defining an interior space in fluid communication with ambient air through the tube bundles; a fan supported above the interior space along the vertical centerline axis, the fan comprising fan blades disposed inside an annular fan shroud; and a drive mechanism operable to rotate the fan blades, the drive mechanism comprising a motor coupled to the fan blades and located inside the fan shroud; wherein the fan is operable to draw ambient air through tube bundles into the interior space. In one embodiment, the fan and motor are mounted to a fan bridge spanning across and over the interior space inside the fan shroud.

According to another aspect, an induced draft air-cooled condenser comprises: a vertical centerline axis; a support structure; a pair of inclined tube bundles supported by the support structure and arranged in a V-shape; the tube bundles defining an interior space in fluid communication with ambient air through the tube bundles; a fan supported above the interior space along the vertical centerline axis, the fan comprising fan blades disposed inside an annular fan shroud; a motor operably coupled to the fan to rotate the fan blades, the motor disposed in a protective enclosure disposed inside the fan shroud above the interior space; and an air inlet duct fluidly coupling an interior of the protective enclosure to ambient air outside the fan shroud; wherein the air inlet duct is configured and operable to draw ambient air through the protective enclosure to cool the motor when the fan is operating. In one embodiment, the protective enclosure comprises an outer end coupled to the air inlet duct, and an opposite at least partially open inner end exposed to the interior space.

According to another aspect, a method for cooling a drive mechanism in an induced draft air-cooled condenser comprises: providing a pair of inclined tube bundles defining an interior space and a fan positioned above the interior space in a fan shroud and in fluid communication therewith; locating a protective enclosure containing a fan motor inside the fan shroud; operably coupling the motor to the fan; coupling an air inlet duct at a first end to the protective enclosure and at a second end to an opening in the fan shroud or extending the second end through the opening in the fan shroud; operating the motor to rotate a plurality of blades of the fan; creating a vacuum in an area beneath the bladed of the fan; and drawing ambient air from outside the fan shroud through the air inlet duct and the protective enclosure to cool the motor via the vacuum. In one embodiment, the locating step comprises positioning the protective enclosure closer to the fan than to the fan shroud.

BRIEF DESCRIPTION OF THE DRAWINGS

The features of the preferred embodiments will be described with reference to the following drawings where like elements are labeled similarly, and in which.

Figure 1:
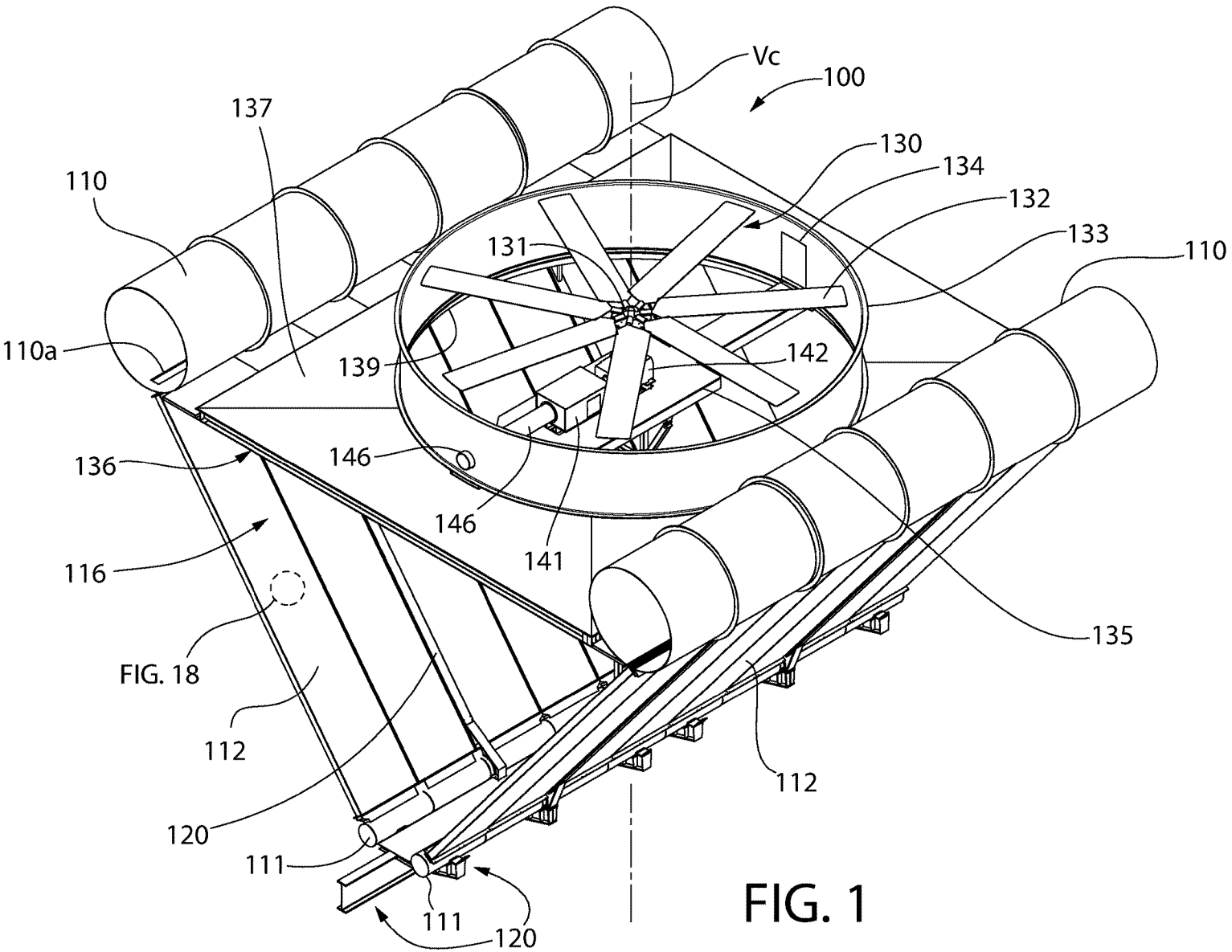
FIG. 1 is a top perspective view of an induced draft air-cooled condenser (IDACC) according to the present disclosure.
Figure 2:
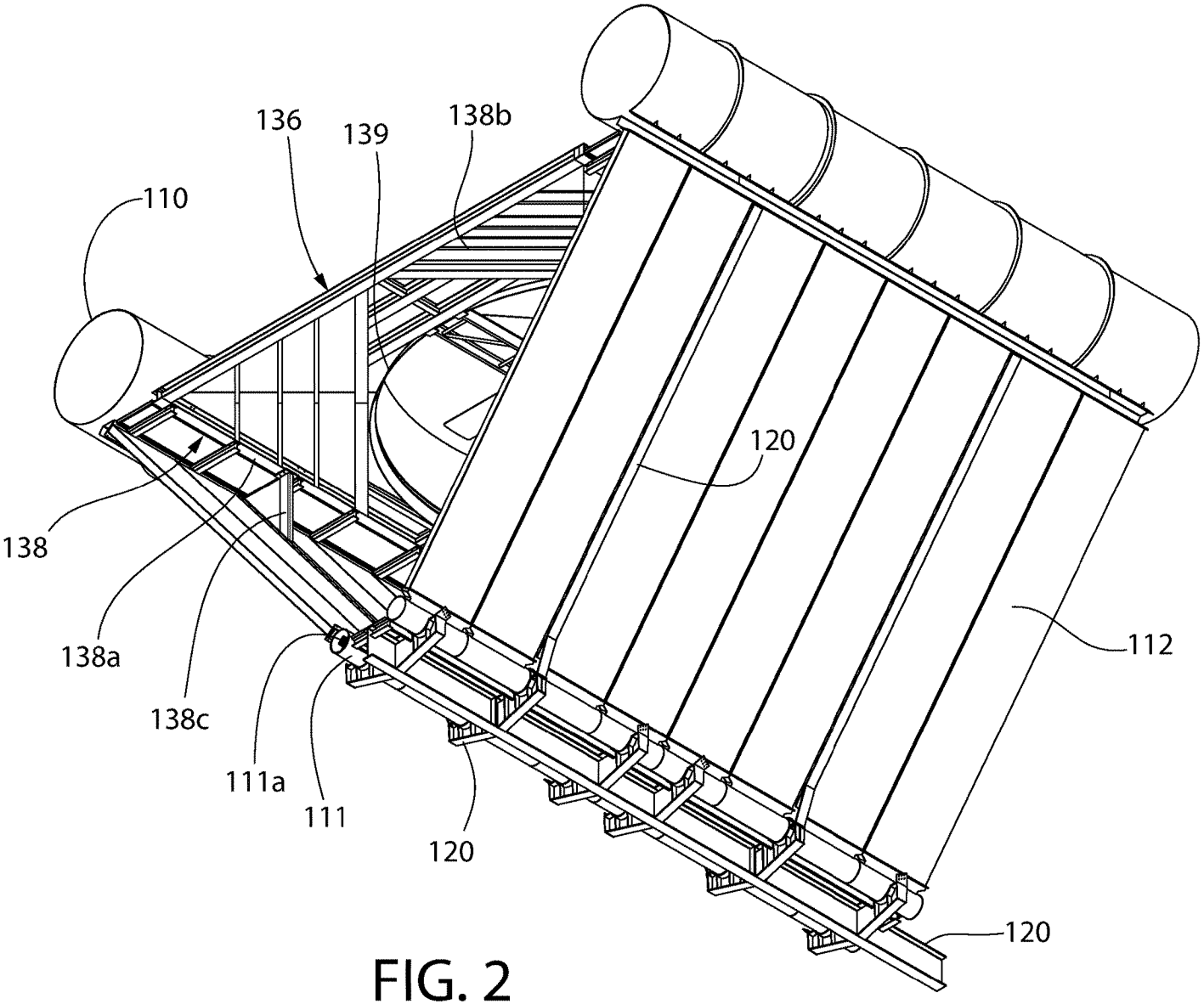
FIG. 2 is a bottom perspective view thereof.
Figure 3:
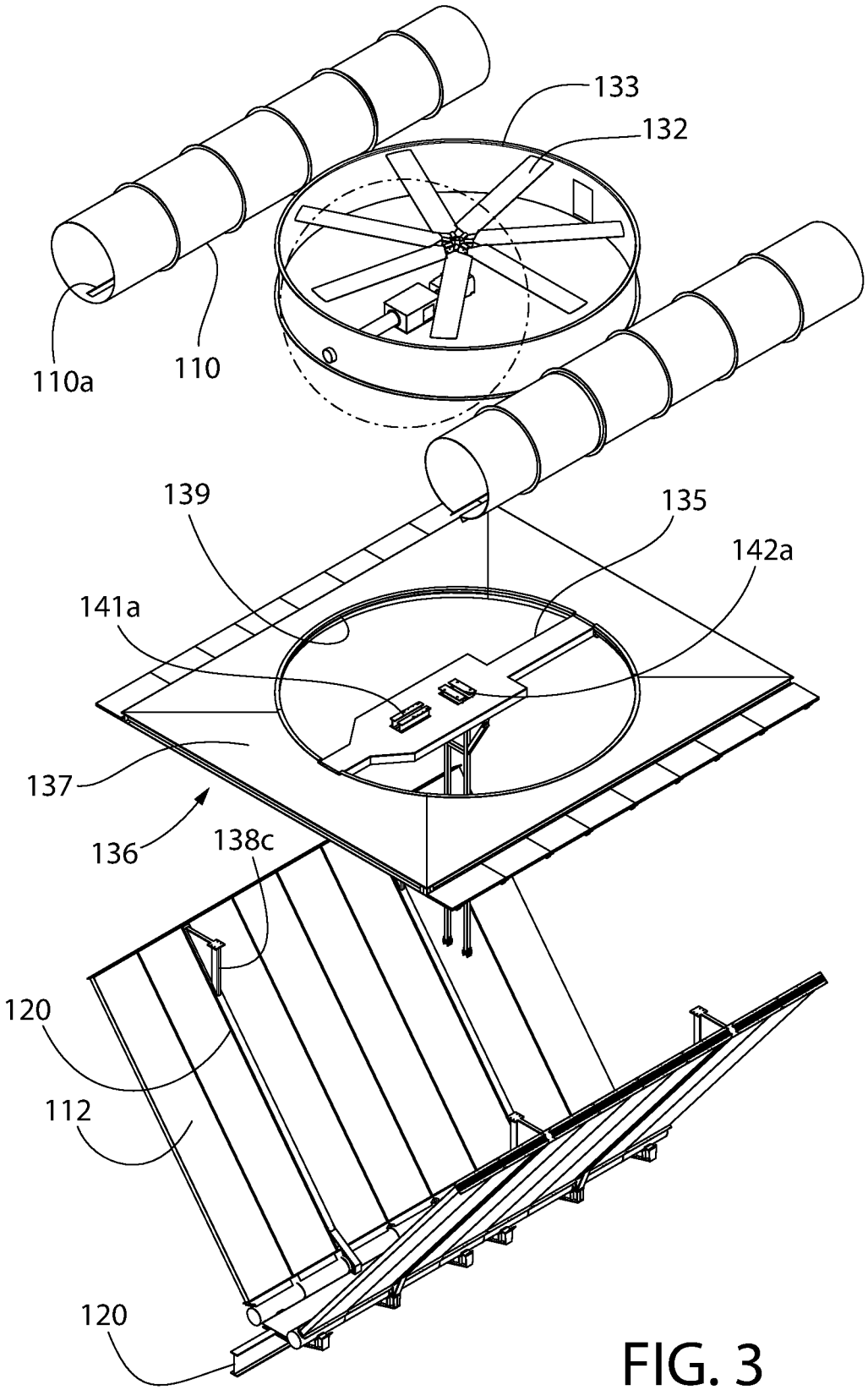
FIG. 3 is a top exploded perspective view thereof.
Figure 4:
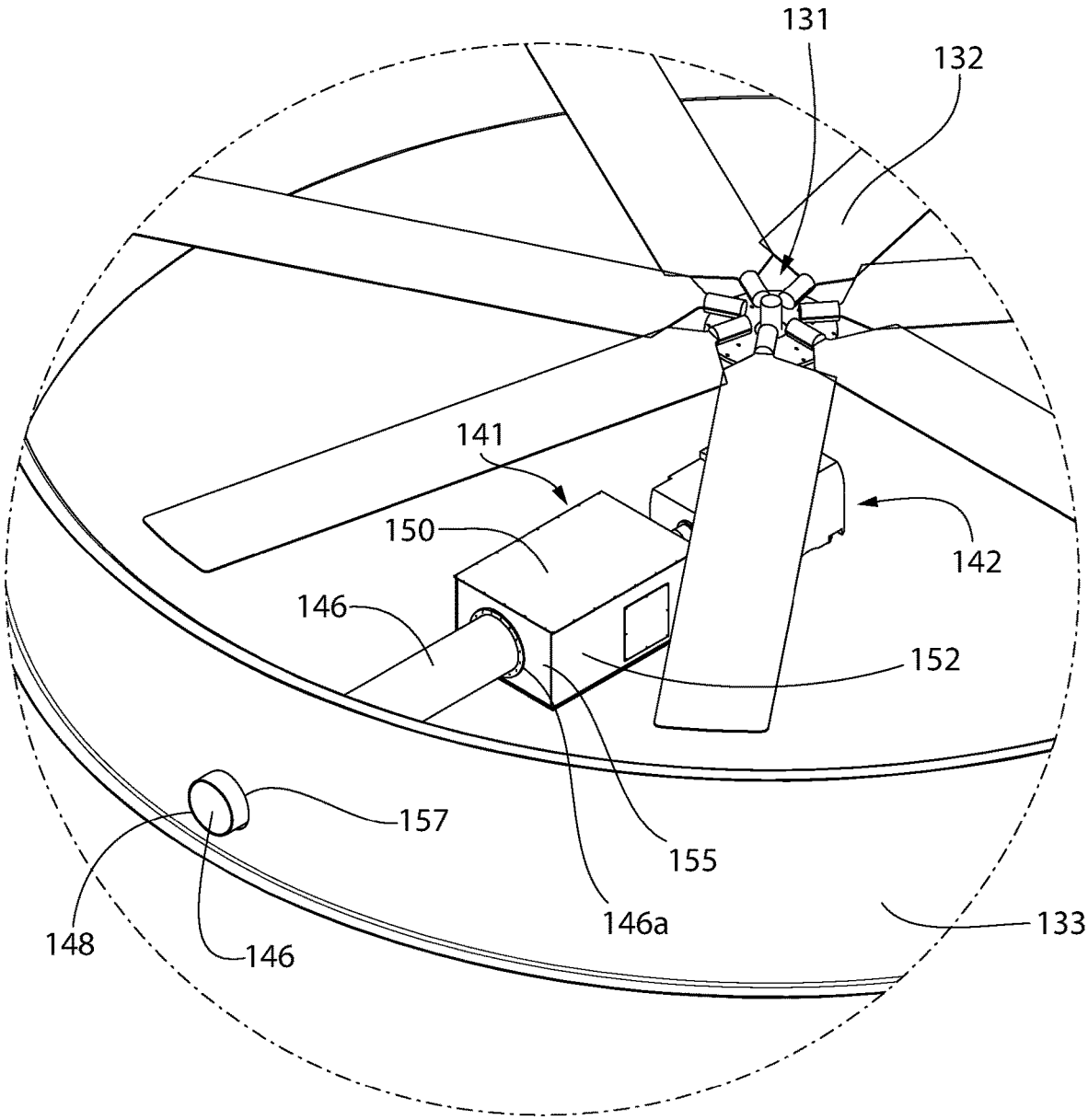
FIG. 4 is an enlarged detail from FIG. 3.
Figure 5:
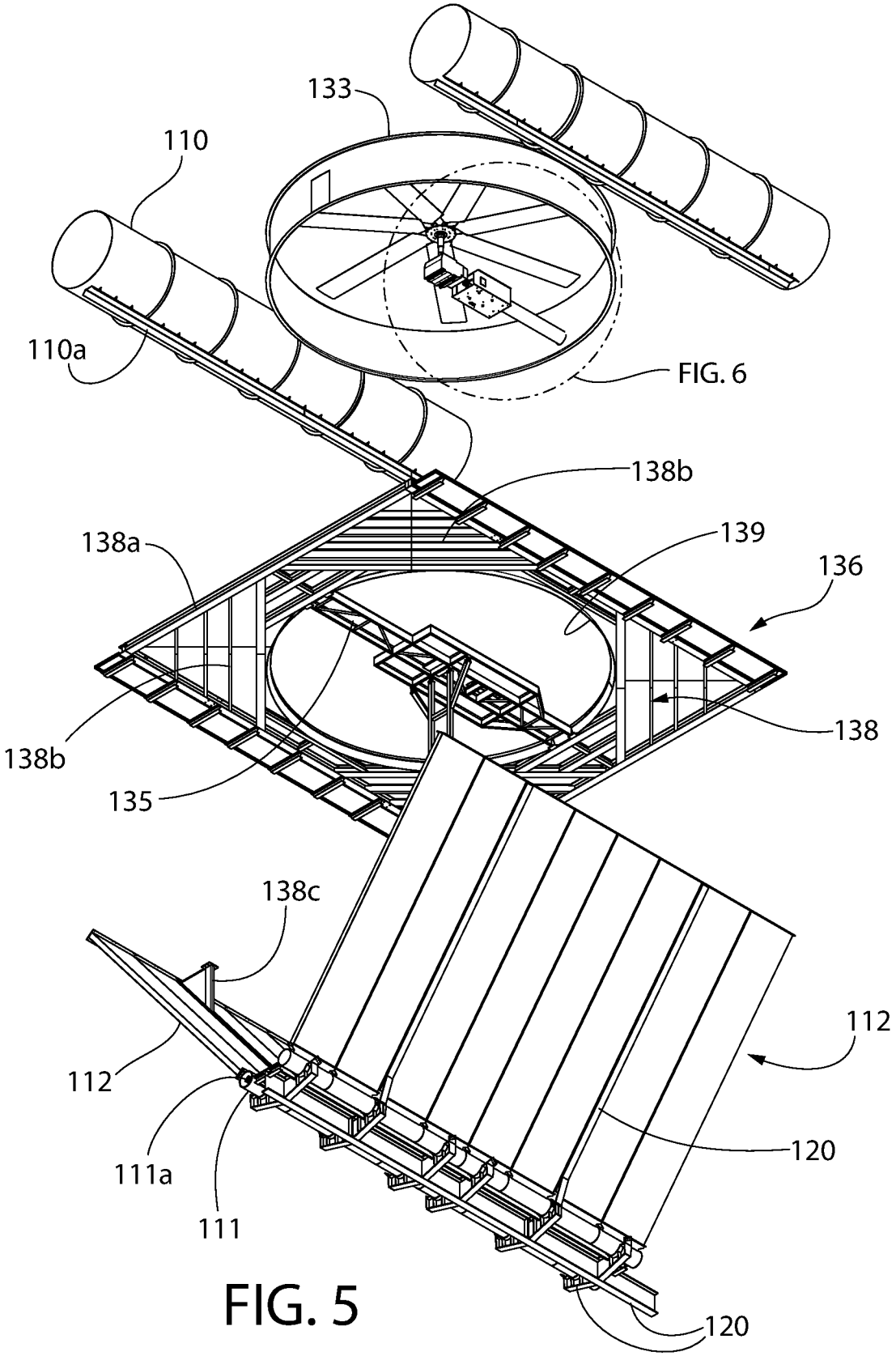
FIG. 5 is a bottom exploded perspective view of the IDACC.

All drawings are schematic and not necessarily to scale. Features numbered in some figures which may appear un-numbered in other figures are the same features unless expressly noted otherwise herein. Any reference which may be made herein to a figure number that may include multiple subpart figures each starting with the same number but with different alphabetic suffixes shall be construed as a general reference to all those figures unless specifically noted otherwise.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

The present induced draft air-cooled condenser (IDACC) is configured and operable to achieve goals of: (a) minimizing the length of the motor drive shaft coupled to the fan gear box by locating the motor inside the fan shroud, and (b) protecting the fan motor from operational issues in such a heated environment within the rising airstream drawn by the fan above the interior space defined between the inclined/angled tube bundles.

In one embodiment, these goals may be accomplished by an IDACC design in which the fan motor is located inside a preferably insulated enclosure and by provision of a fan motor cooling system operably to draw cool ambient air through the enclosure while bypassing the rising heat airstream inside the fan shroud. These aspects of the present invention are further described in detail below.

Figure 19:
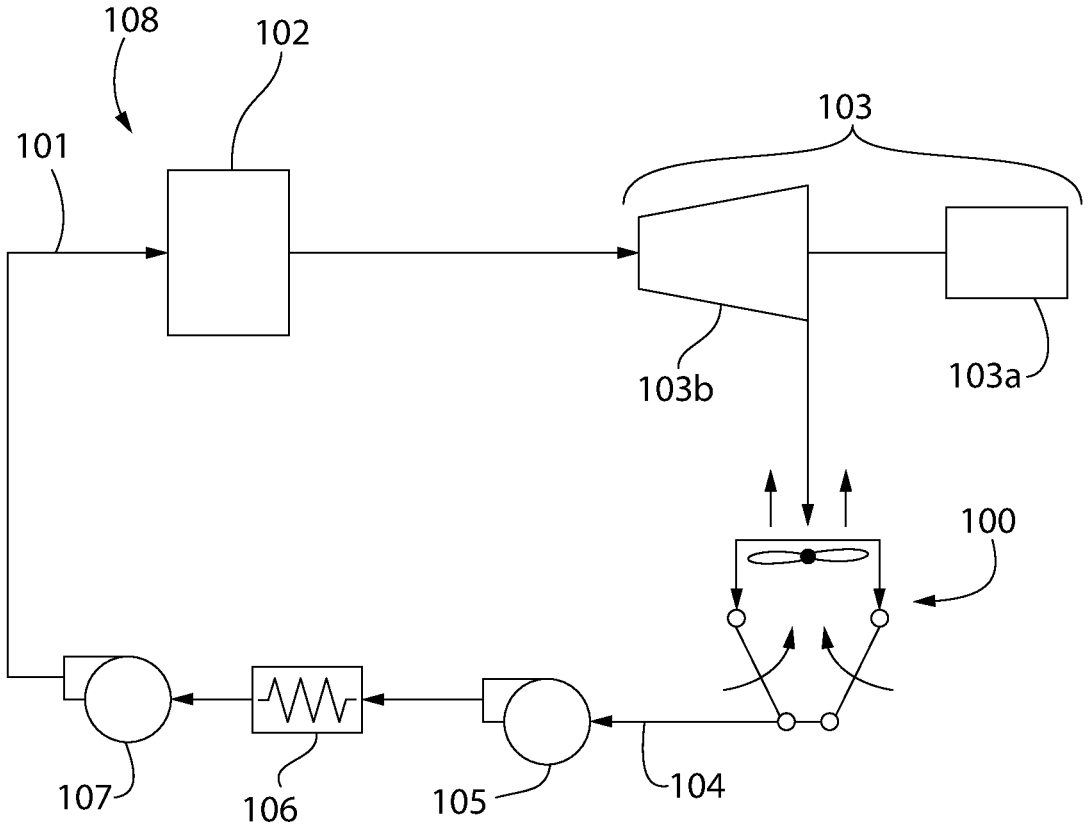
FIG. 19 is a schematic flow diagram of a power generation Rankine cycle comprising the IDACC of FIG. 1.

FIG. 19 is a schematic flow diagram of a conventional Rankine cycle flow loop 108 of a thermal electric power generation plant. An induced draft air-cooled condenser system according to the present disclosure comprises induced draft air-cooled condenser (IDACC) 100 fluidly coupled to the Rankine cycle flow loop 108 in a steam condensing application. A single IDACC is shown for clarity of depiction recognizing that the condenser system would in reality comprise a plurality of IDACC units assembled in an array to meet the heat rejection load demand to condense the steam into condensate. The power generation plant may be a nuclear plant, fossil fired plant, or utilize another energy source such as renewables including biomass, trash, or solar in various embodiments as some non-limiting examples. The electric power generating portion of the plant comprises a turbine-generator set 103 including an electric generator 103*a* and steam turbine 103*b* operably coupled to the generator for rotating a rotor to generate electricity via stator windings in the generator in a well known manner. A steam generator 102 using any of the foregoing energy sources heats feedwater to produce steam for the cycle. In various embodiments, the source of heat for the steam generator may be a nuclear reactor, a furnace which burns a fossil fuel (e.g. coal, oil, shale, lignite, natural gas, etc.), or other non-renewable or renewable energy sources such as mentioned above. The heat and fuel source do not limit the application of the IDACC invention.

The IDACC 100 is fluidly connected to condensate return piping 104 to direct the liquid condensate produced by the IDACC back to a condensate return pump 105, which pumps the condensate in flow loop 108 to the steam generator 102. The condensate is generally pumped through one or more feedwater heaters 106 which uses steam extracted from various stages in the steam turbine 103*b* to pre-heat the condensate. The pre-heated condensate may be referred to as "feedwater" at this stage in cycle. Feedwater pumps 107 further pressurizes and pumps the feedwater to a steam generator 23 where the liquid feedwater is heated, evaporated, and converted into steam. The high pressure steam flows through the steam turbine 103*b* which in turn produces electricity in a known manner via electric generator 103*a*. The pressure of the steam drops as it progressively flows through the turbine converting thermal and kinetic energy into electric energy. The low pressure steam at the outlet or exhaust of the turbine (i.e. "exhaust steam") is piped to the IDACC 40 where it condenses into condensate and continues on in the Rankine cycle flow loop 20 to complete the flow path. A steam condensing closed flow loop comprising the IDACC 100 is thus formed and fluidly coupled to the Rankine cycle flow loop 108 between the steam turbine 103*b* and condensate pump 105 in this example.

FIGS. 1-20 show various aspects of IDACC 100. IDACC 100 generally comprises a pair of upper steam headers 110, lower condensate headers 111, and inclined or angled tube bundles 112 extending therebetween and fluidly connected to the header at top and bottom. Steam headers 110 are laterally spaced wider apart than the condensate headers 112 creating the characteristic V-shaped IDACC shown. Tube bundles 112 may be oriented at any suitable acute angle to each other, which for example without limitation may be about 60 degrees in some embodiments.

Figure 7:
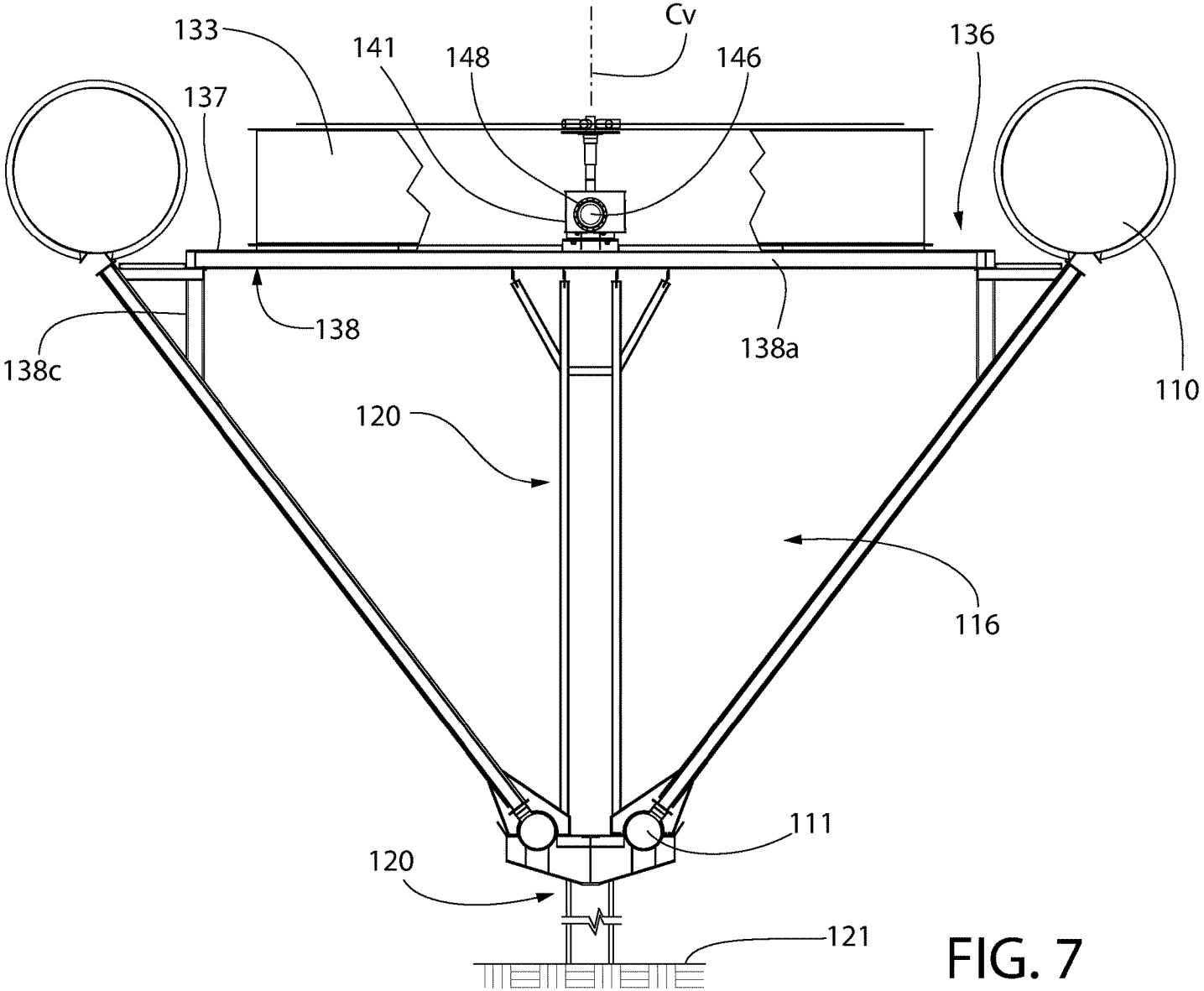
FIG. 7 is a first end view of the IDACC.
Figure 8:
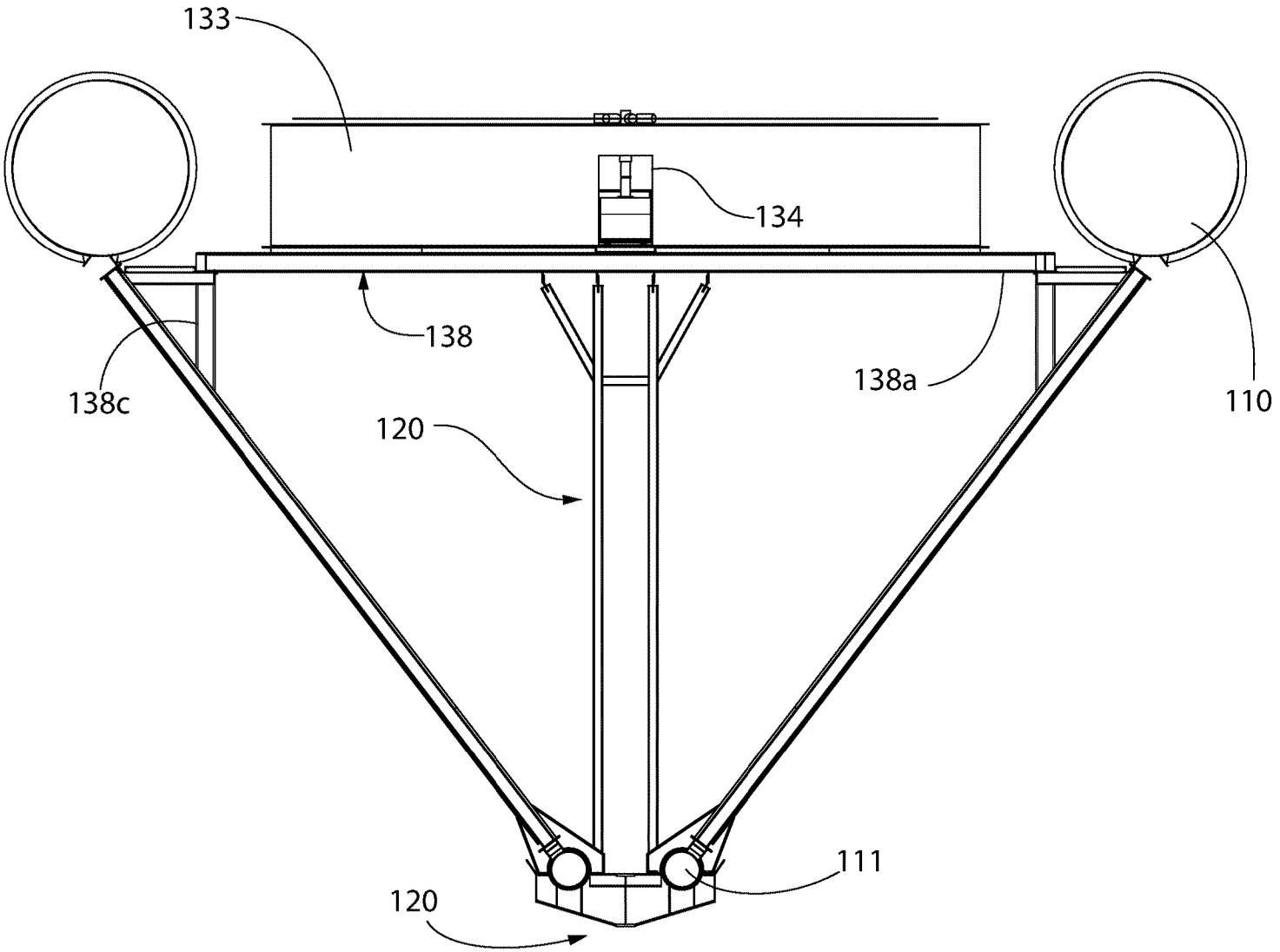
FIG. 8 is a second end view of the IDACC.
Figure 9:
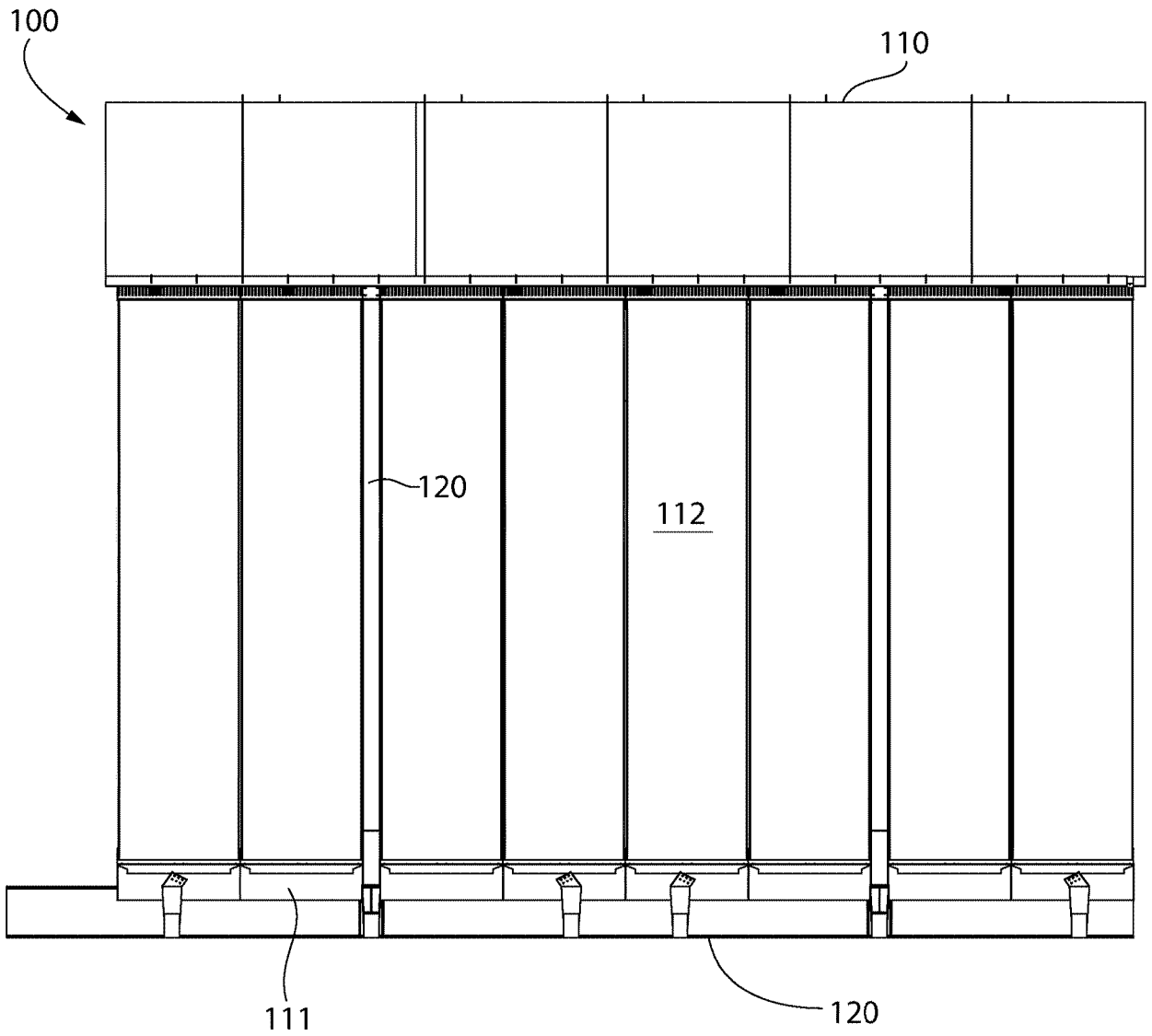
FIG. 9 is a side view of the IDACC.
Figure 10:
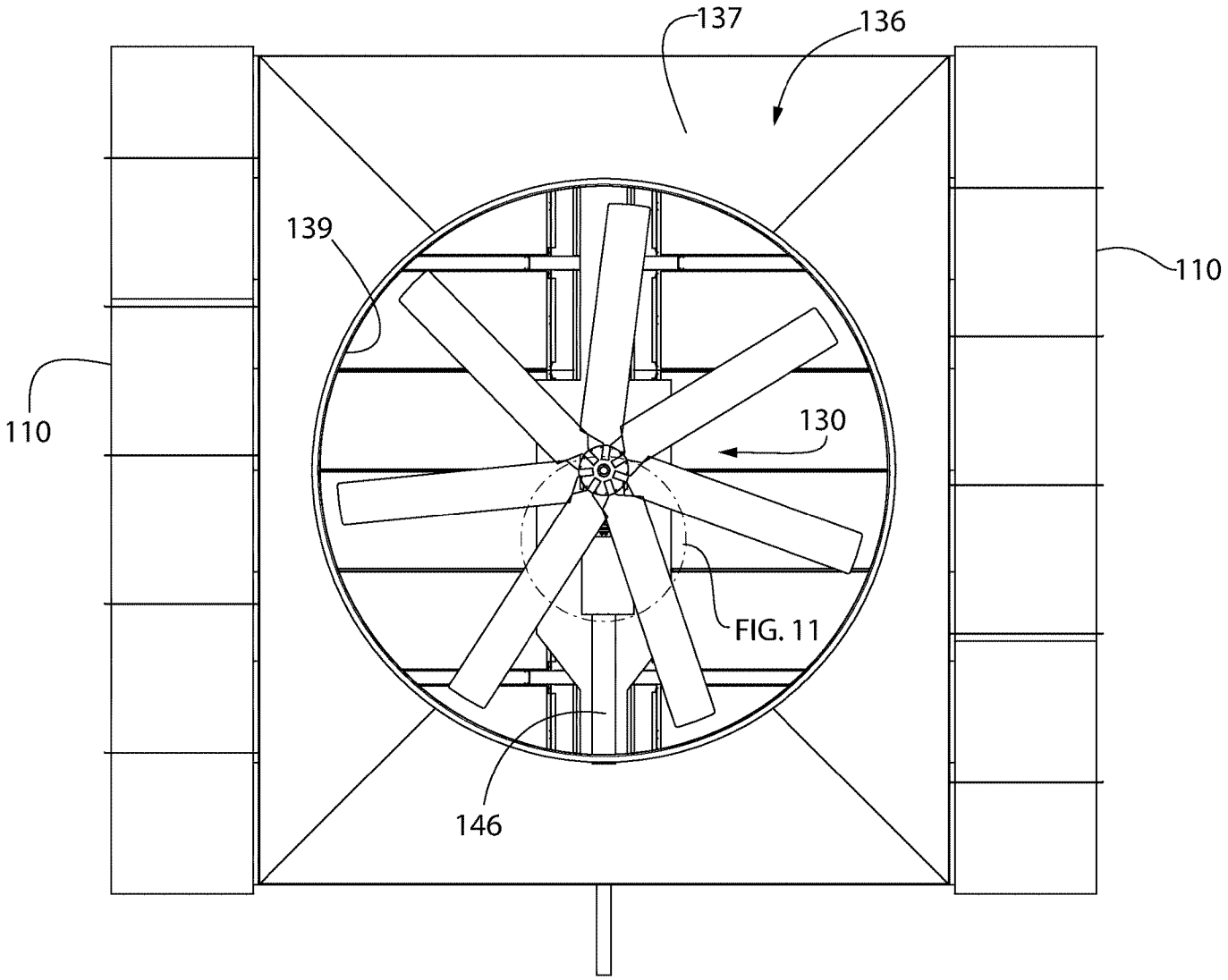
FIG. 10 is a top view of the IDACC.
Figure 11:
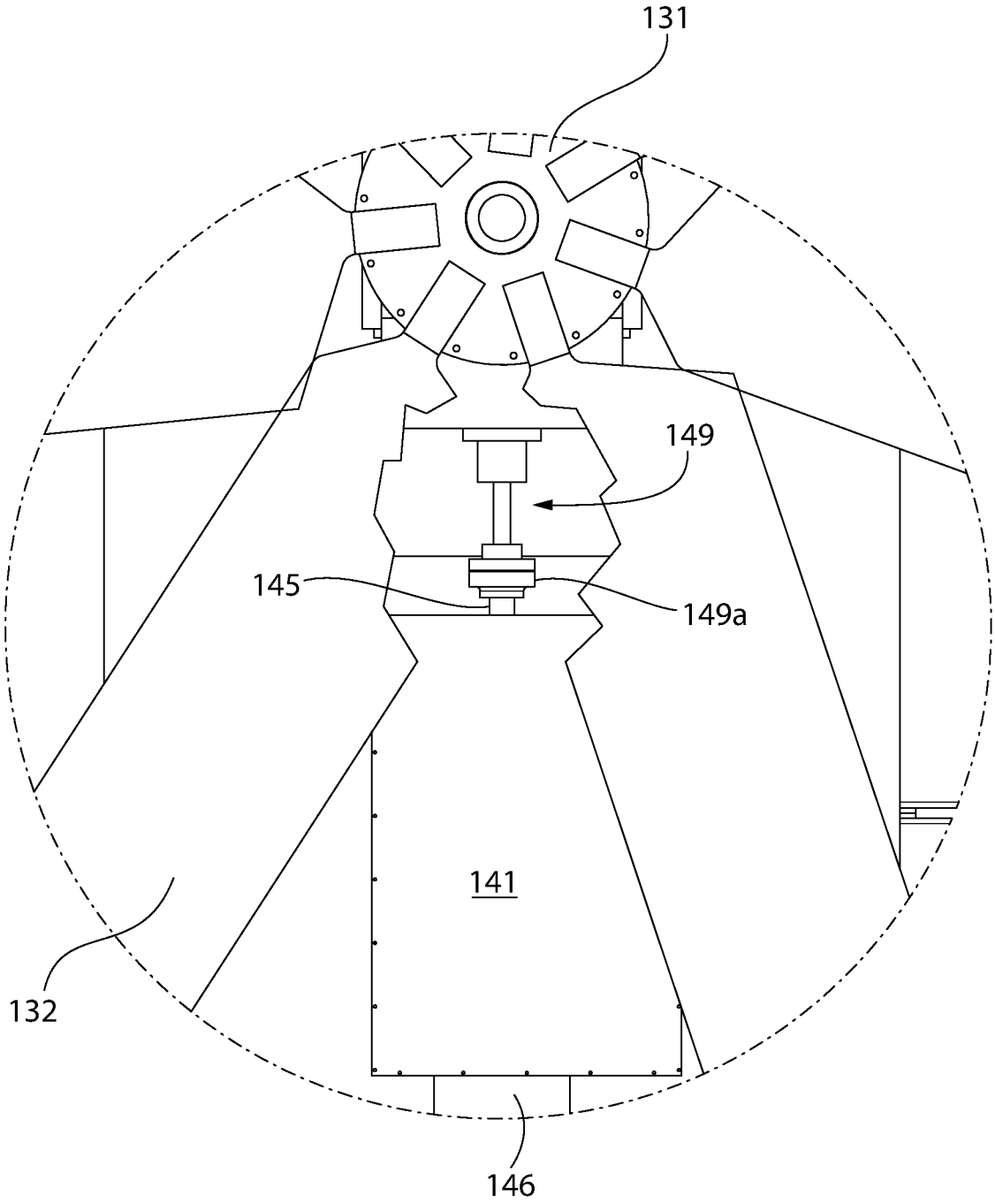
FIG. 11 is an enlarged detail from FIG. 10.
Figure 12:
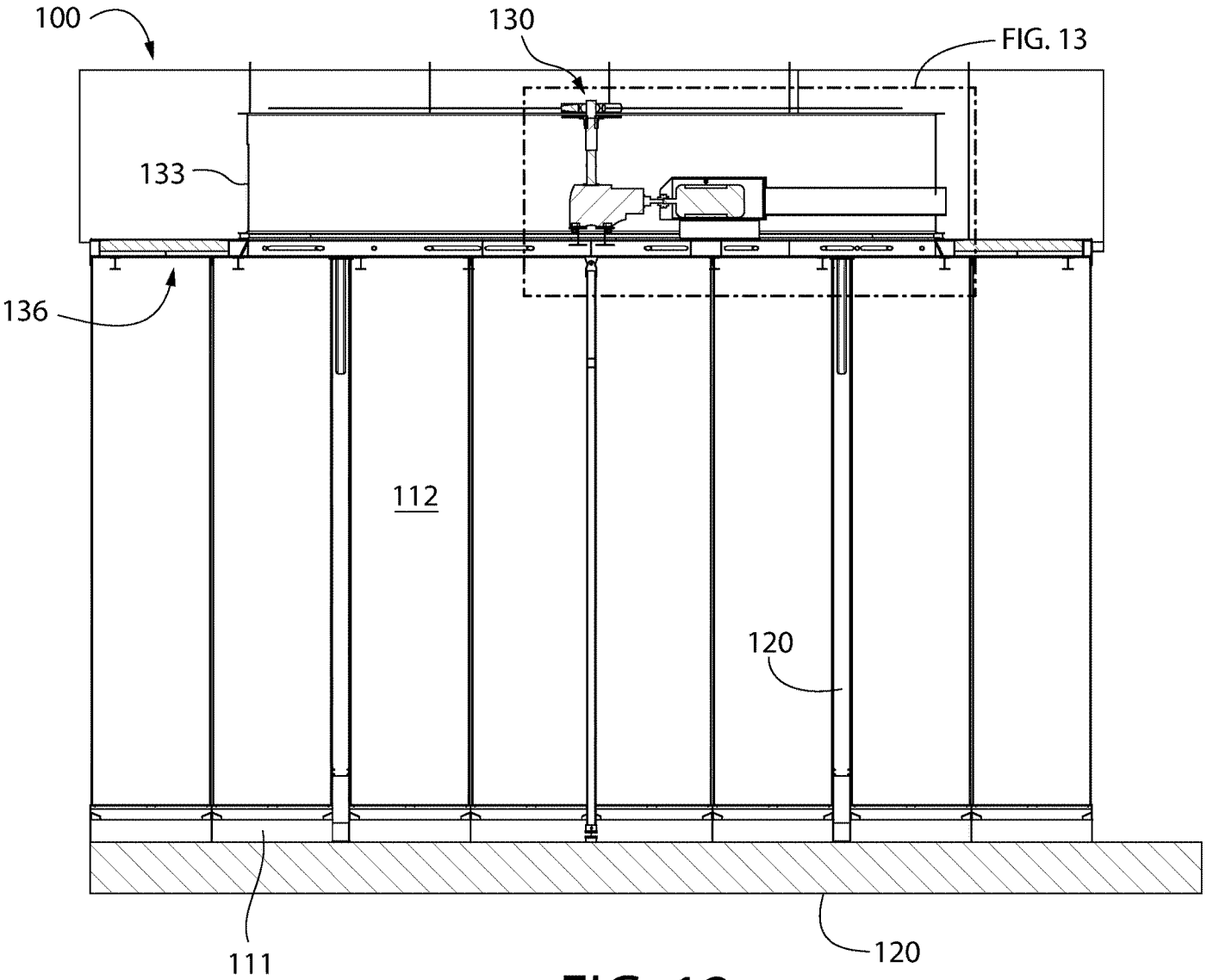
FIG. 12 is a side cross-sectional view taken through the vertical centerline axis of the IDACC and shows the drive mechanism components of the fan.

The V-shaped IDACC structure including the fan and related appurtenances is supported by the IDACC support structure 120 whose various structural members may comprise a plurality of structural beams, columns, struts, trusses and other structural members of various sizes and orientations which are collectively configured and coupled together to support and elevate the IDACC and its appurtenances described herein above grade in a stable manner (best shown in FIGS. 1-7 and 20). Support structure 120 is thus configured to support the IDACC from a stationary and generally horizontal support surface 121 at grade which may be defined by ground/soil, concrete pads or footers, or a steel platform. The support surface 121 and support structure 120 may thus take numerous forms and is not limiting of the invention. FIGS. 7 and 8 show the support structure 120 and support surface 121 in substantial isolation (in addition to the fan and steam and condensate headers supported by the support structure).

The inclined tube bundles 43 in one embodiment may be shop-manufactured straight and generally planar/flat tube bundles each comprised of closely spaced apart parallel tubes 114 aligned in a single linear row and arranged in a single inclined plane (relative to vertical centerline axis Cv and horizontal). Tubes 114 may have a generally obround or rectangular cross sectional shape (see, e.g. FIG. 18). Each straight tube is fluidly connected at opposite ends to and supported by one of the steam and condensate headers 110, 111. Specifically, tubes 114 are coupled to an upper tubesheet 110*a* in the steam headers 110 and lower tubesheet 111*a* in the condensate headers 111. The tubesheets each contain a plurality of tube openings or penetrations for allowing steam or condensate to be exchanged with the headers and flow into and out of the tubes 114 on the open interior tube side of the tubes which define closed flow passageways. The tube ends may fixedly coupled to the tubesheets in a leak-proof manner by being seal welded, brazed, or expanded (e.g. hydraulically or explosively) to the tubesheets to form fluidly sealed connections. The tubesheets 110*a*, 111*a* may flat in one embodiment and formed of straight metallic plates with the plurality of openings/penetrations.

Figure 18:
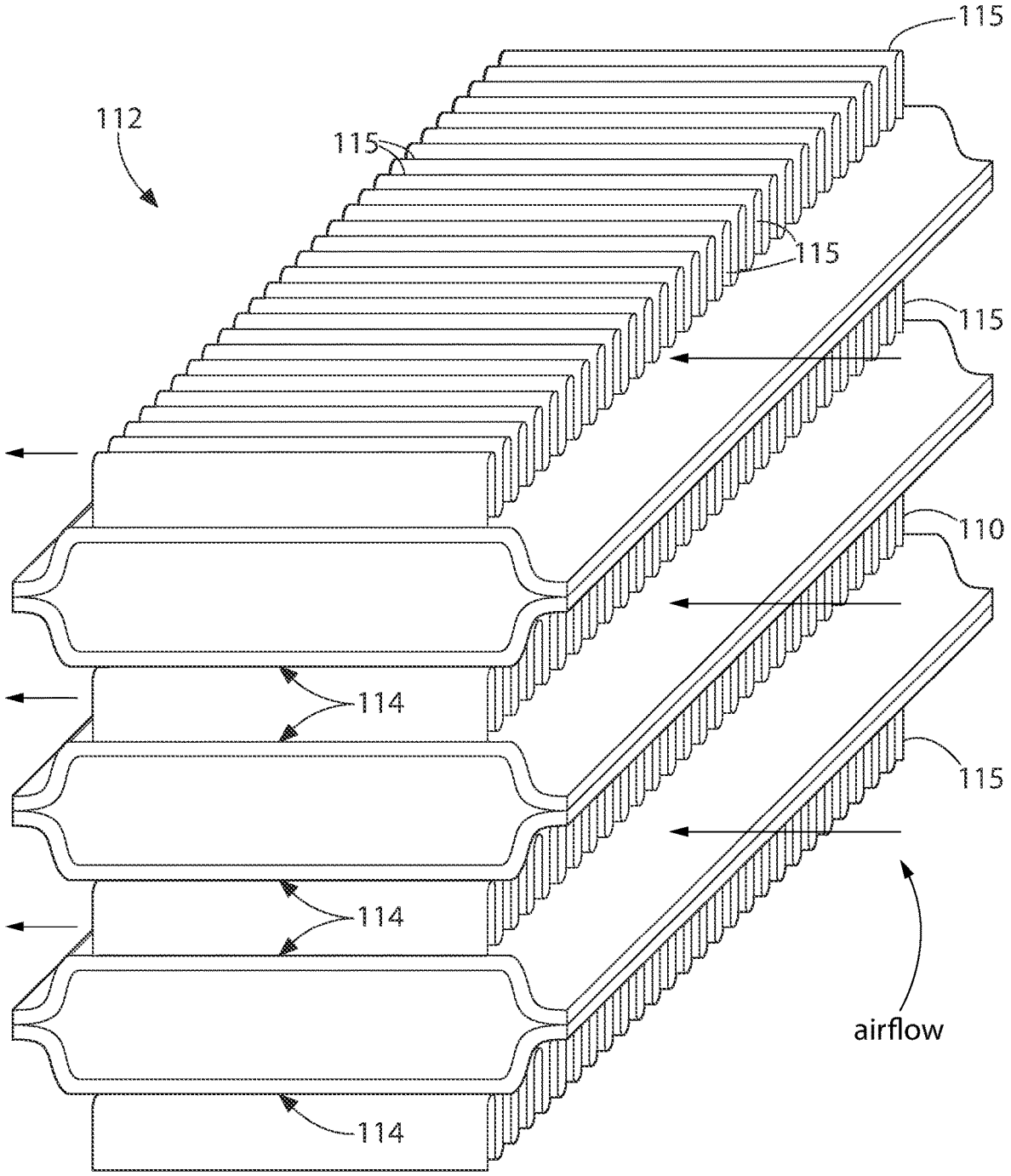
FIG. 18 is a detail taken from FIG. 1 showing a section of finned heat transfer tubes from one of the inclined tube bundles of the IDACC.

In one embodiment, the tubes 114 may include heat transfer fins 115 attached to opposing flat sides of the tubes and projecting perpendicularly outwards therefrom in opposing directions, as best shown in FIG. 18. When the tube bundles 112 are assembled, the fins of one tube 114 preferably are very closely spaced in relation to the fins of an adjacent (but spaced apart) tube to ensure cooling airflow generated by fan 130 flowing through the tube bundles 112 makes maximum surface contact with the fins for optimum heat exchange/transfer for steam condensing. In other implementations, the tubes however may be finless.

The inclined tube bundles 112 define an interior space 116 therebetween beneath fan 130. The interior space is in fluid communication with ambient air outside the tube bundles through the tube bundles between their tubes 114. During operation of the IDACC 100, ambient air drawn through the tube bundles by fan 130 is heated by the tube-side fluid (i.e. steam) as it condenses and transfers its heat to the air. Accordingly, interior space 116 may be considered to form a heat sink for condensing steam.

Figure 20:
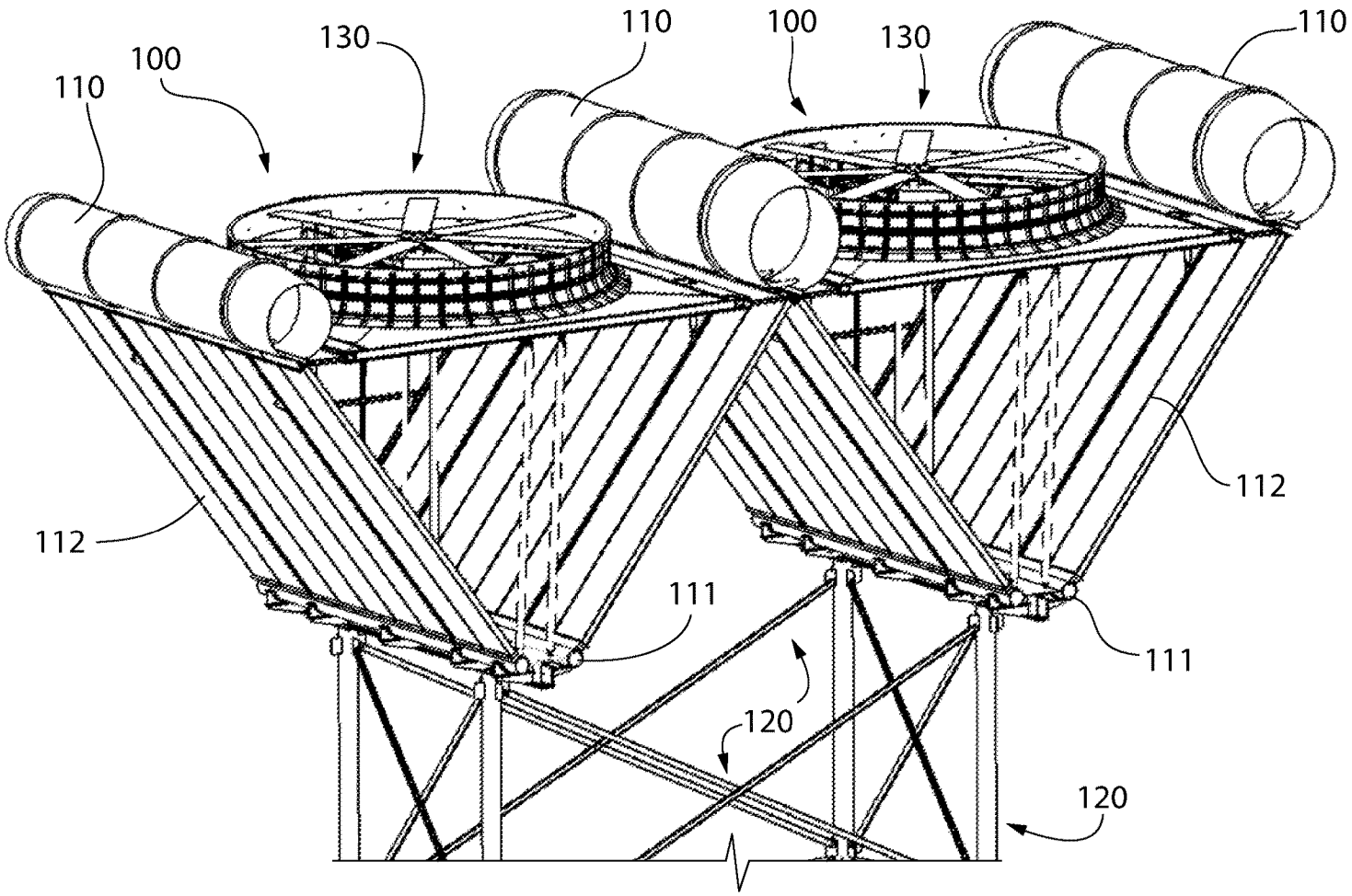
FIG. 20 is a perspective view of a portion of an IDACC installation comprising multiple cooling cells each comprising an IDACC according to the present disclosure.

It bears noting the IDACC shown is one of multiple IDACCs which may be provided in a complete IDACC condensing system installation. Each IDACC 100 may be thought of as a cooling cell or unit which can be fluidly coupled together in a concatenated fashion (in series) at the steam and condensate header joints to service the entire cooling duty required to condense the steam from and return the condensate to the Rankine cycle flow loop 108. Each cooling cell may include multiple tube bundles 112 on each side arranged in series. Multiple longitudinally-extending series or rows of cooling cells arranged laterally adjacent to each other to form a rectilinear array of cells in a traditional manner. FIG. 20 shows two cells of IDACCs 100 arranged adjacent to each other. Each of these two cells would in turn be fluidly coupled to other cells in series to form the array. The steam and condensate headers 110, 111 in each IDACC cooling cell may each be a single long monolithic continuous flow conduit or be comprised of multiple header sections which are mechanically and fluidly coupled together at jointed therebetween as shown within each cell such as via welded or bolted flanged connections to form the continuous flow conduit. Laterally adjacent IDACC cells typically share a common steam header 110 between them to reduce costs (see, e.g. FIG. 20).

Figure 13:
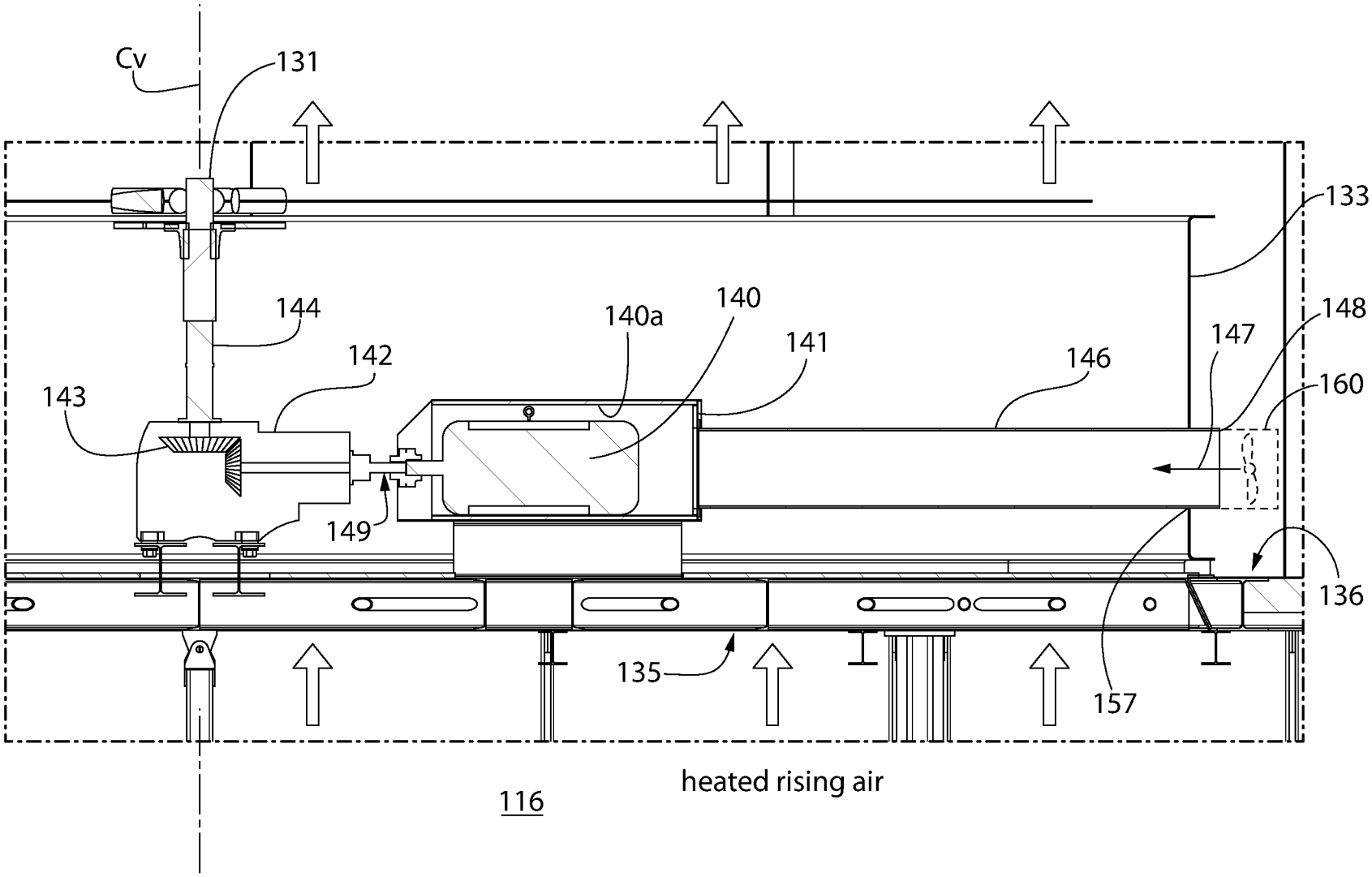
FIG. 13 is an enlarged detail from FIG. 12 focusing on the drive mechanism components.
Figure 14:
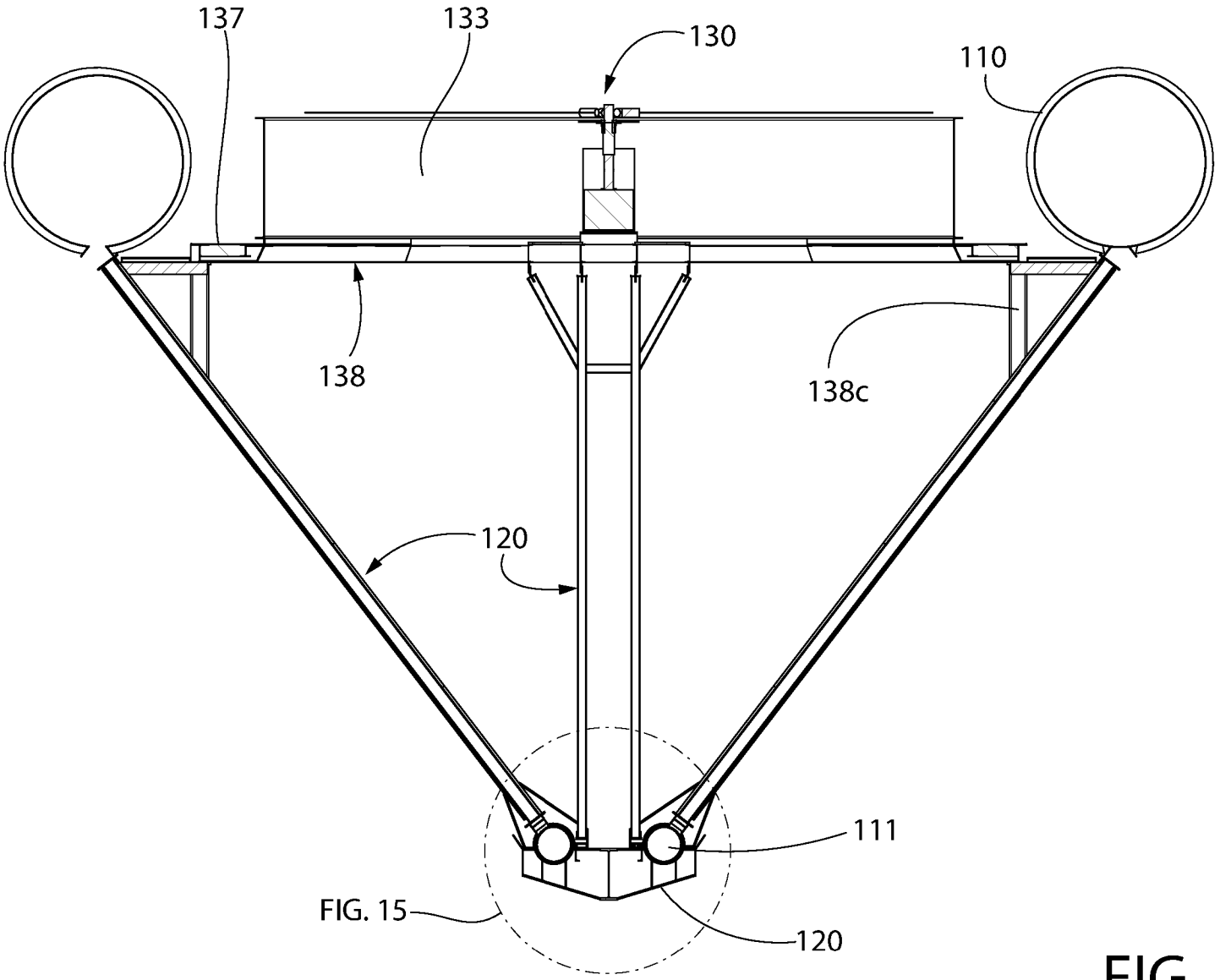
FIG. 14 is a transverse cross-sectional of the IDACC.
Figure 15:
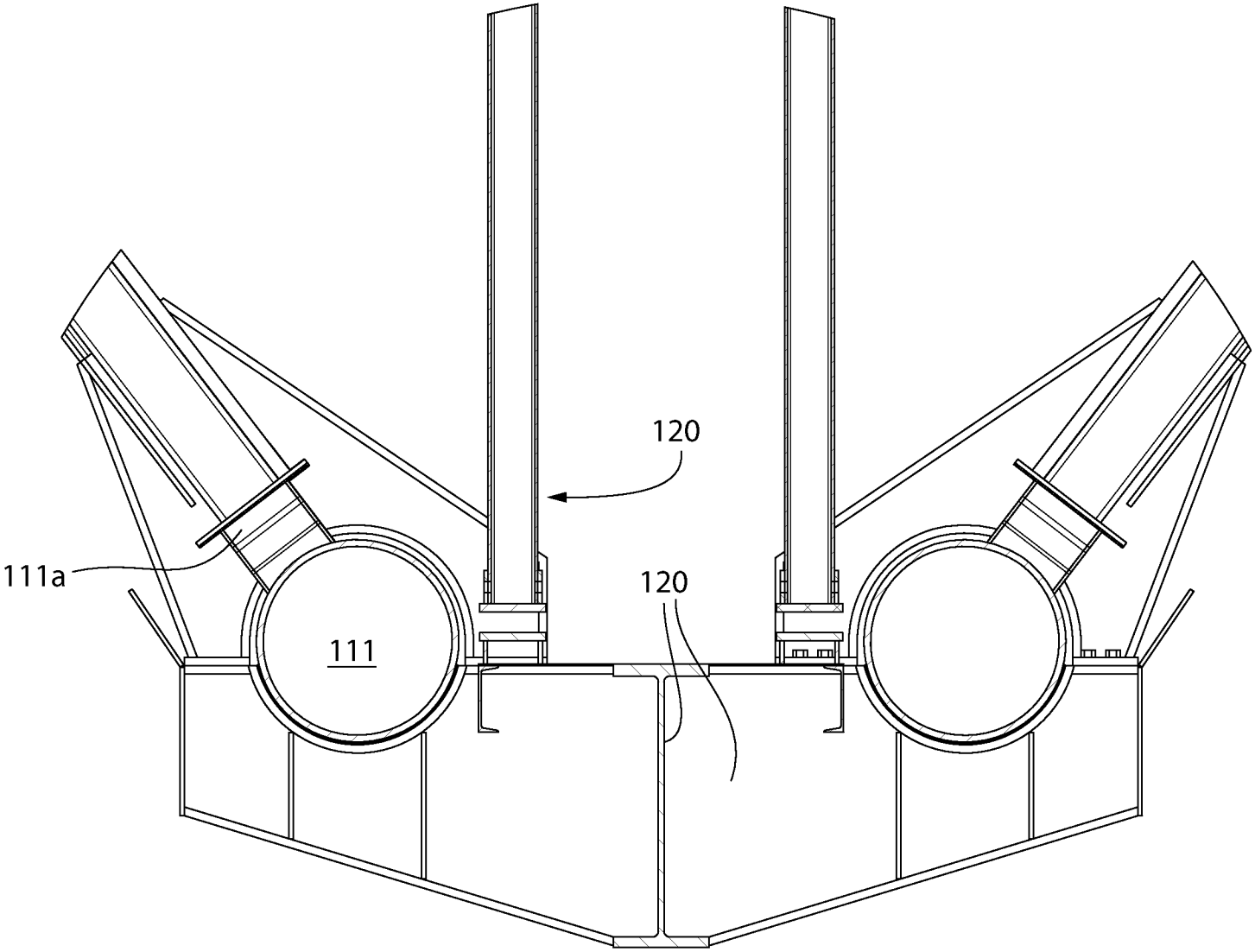
FIG. 15 is an enlarged detail from FIG. 14.
Figure 16:
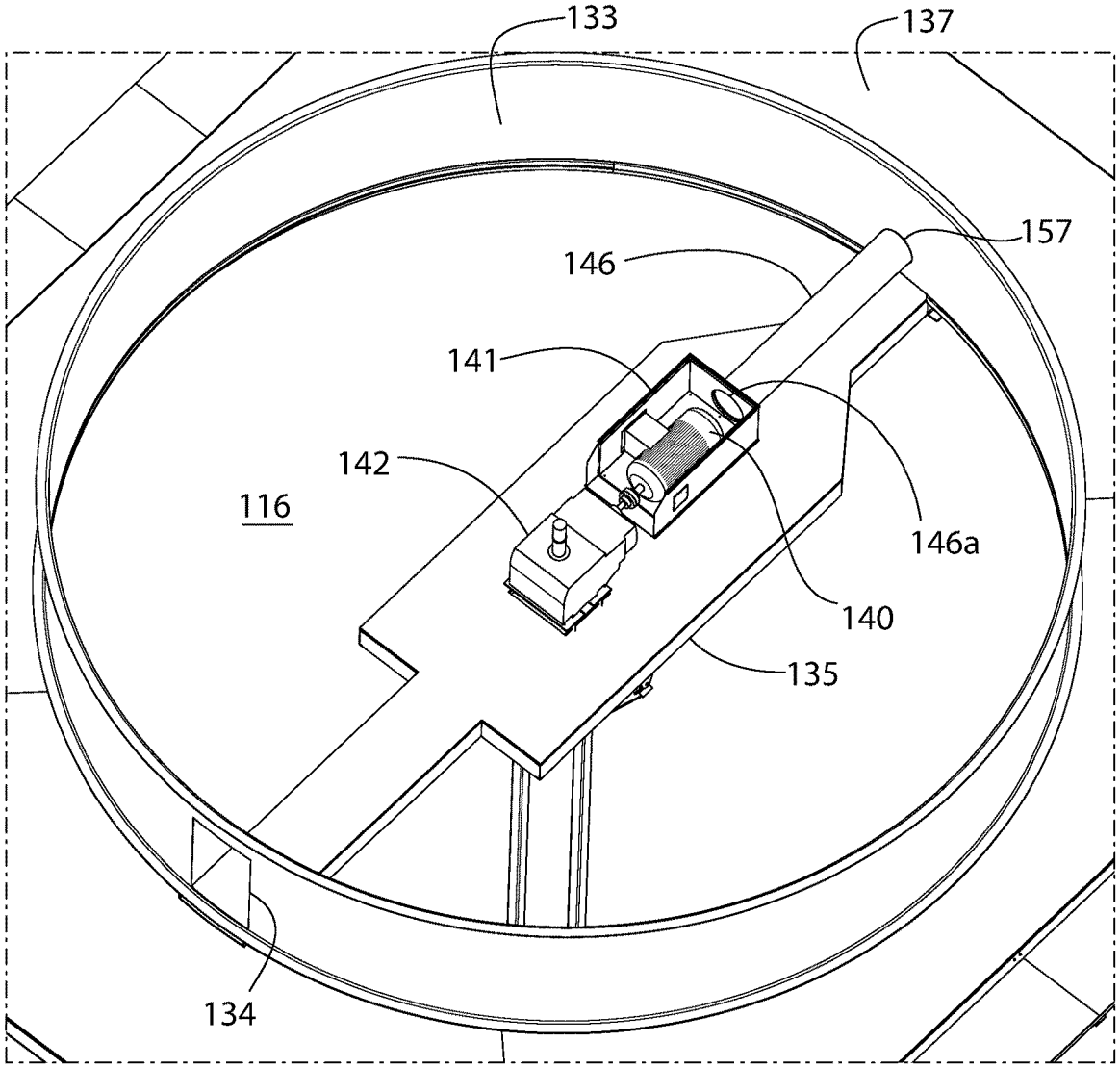
FIG. 16 is a partial top perspective view of the IDACC showing the drive mechanism components comprising the gear box and motor (top of motor protective enclosure removed for clarity of depiction)

For convenience of reference in describing various aspect of IDACC 100 and their spatial and orientation relationship to one another, IDACC may be considered to define a vertical centerline axis Cv which coincides with the vertical centerline (i.e. axis of rotation) of the fan hub 131 and fan drive shaft 144 (see, e.g. FIG. 13). The steam and condensate headers 110, 111 are oriented transversely and perpendicularly to centerline axis Cv.

Referring initially in general to FIGS. 1-20, IDACC 110 includes a horizontal fan platform or deck 136 at top supported by support structure 120. Fan deck 136 has a generally rectangular/square overall shape and comprises flat fan deck plate 137 and an underlying fan support frame 138. The fan support frame 138 may comprise a combination and arrangement of peripheral beams 138*a* defining a perimeter portion of the frame, laterally/horizontally extending cross beams 138*b* extending at various angles between portions of the peripheral beams, and vertical members or columns 138*c* structurally tied into portions of the support structure 120 of the IDACC nested within/between the tube bundles 112. The vertical columns 138*c* may in turn be tied into the peripheral beams 138*a* of the fan support frame 138, which in turn supports the cross beams. It bears noting that any members of the fan support frame described above may also be considered to form an integral part of the IDACC support structure 120 as they are fixedly coupled together (e.g. welded and/or bolted) into an assemblage to form the complete superstructure of the IDACC shown.

Fan deck 136 supports fan 130 above and at the top of the interior space 116 defined between the inclined tube bundles 112. The fan deck 136 including deck plate 137 define a large central opening 139 in which the fan 130 is positioned and centered. Fan 130 is supported in central opening 139 by structural fan bridge 135. Fan bridge 135 spans across the central opening and above the interior space 116 between the tube bundles 112. The fan bridge is structurally supported at each of its opposite ends by the fan deck 136 (specifically fan support frame 138).

The fan 130 is an assemblage of components supported by fan bridge 135 and comprises a drive mechanism operable to rotate the plurality of fan blades 132 located inside annular fan shroud 133. The drive mechanism comprises an electric fan motor 140 having a rotating motor shaft 125 operably coupled to a gear box 142 which houses the gear train 143 inside. Such gear trains for IDACCs are known in the art without undue elaboration and may comprise a plurality of intermeshed gears of various types and orientations as needed. The gear train is in turn coupled via the vertical fan drive shaft 144 to the hub 131 of the fan from which the plurality of fan blades 132 project radially outwards in multiple directions (best shown in FIGS. 12 and 13). The gear box 142 may be located directly below the fan hub 131 in one embodiment. The gear train 143 is configured via the gearing selected (e.g. bevel gears as shown) to convert the rotation of the motor shaft 125 in a horizontal plane to rotation of the fan blade drive shaft 144 in a vertical plane to in turn spin the fan blades. The gearing may be selected to step up or step down the rotational speed (e.g. RPM) of the motor shaft which is transmitted to the fan drive shaft.

Figure 17:
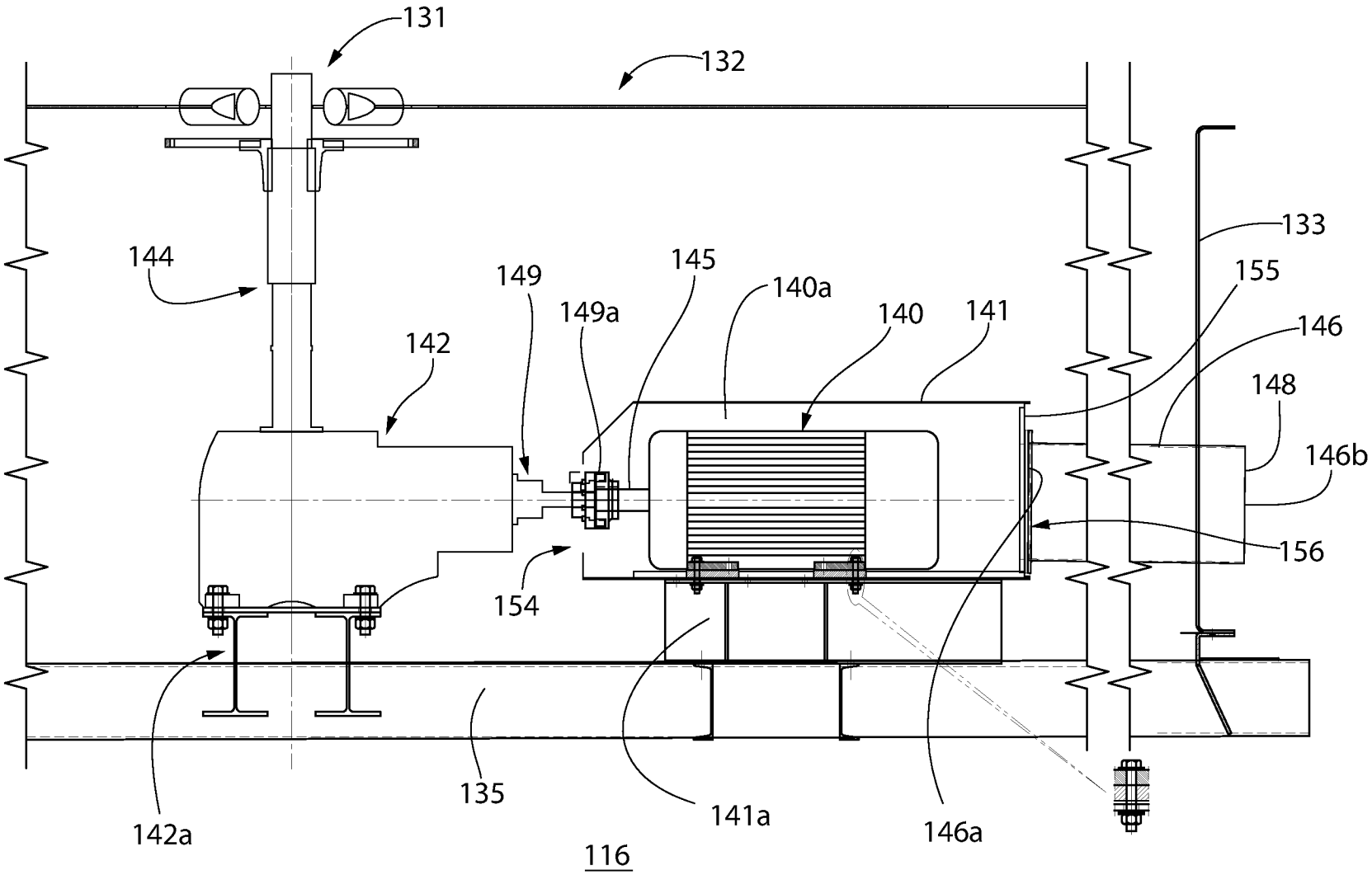
FIG. 17 is an enlarged side view of the drive mechanism components further showing aspects of the motor cooling air system.

Referring to FIGS. 13 and 17, the motor 140 is supported by the fan bridge 135 on a mounting base 141*a* which raises and places the motor shaft 145 at the proper elevation for coupling to the gear train input shaft 149. A shaft coupling 149*a* couples the two shafts together. Gear box 142*a* is similarly supported by the bridge on mounting base 142*a*. Mounting bases 141*a* and 142*a* may each comprise an assemblage of several structural members fixedly attached to the fan bridge and the motor and gear box.

The fan 130 and its rotating fan blades 132 are disposed inside annular fan shroud 133. Fan hub 131 to which the blades are attached is centrally located inside the shroud along vertical centerline axis Cv. Fan shroud 133 has a generally cylindrical structure of certain height and extends upwards from and is supported by the fan deck 136 at the edges of central opening 139 in the deck. Fan blades 132 may have a length such that the tip of the blades terminate proximate to the shroud 133 as illustrated. The shroud serves two purposes. First, the shroud 133 helps funnel and direct the rising air in interior space 116 heated by the tube bundles 112 into the axial flow fan 130 disposed closer to the top of the shroud than the bottom. Second, the shroud protects operating personnel or workers who may be working on the fan deck outside the shroud from the spinning blades. Shroud 133 may include an access opening 134 arranged to allow personnel to access the fan bridge 135 for maintaining the fan and its gear train and motor (see, e.g. FIG. 1 et al.). An access door (not shown) may be hingedly mounted to the shroud to close the access opening. Fan shroud 133 is preferably formed of a suitable metallic material (e.g. steel, aluminum, etc.).

In one preferred arrangement, fan motor 140 is located proximate and adjacent to the gear box 142 on fan bridge 135 forming a closely coupled relationship via motor shaft 145 (see, e.g. FIG. 17 et al.). Accordingly, motor 140 is disposed closer to the fan blade hub 131 and IDACC vertical centerline axis Cv than the outside of the edge of the fan deck 136 which defines central opening 139 therein or the fan shroud 133. This sharply contrasts to past designs in which the fan motor is actually located outside of the fan shroud 133, disadvantageously resulting in extremely long motor shafts (e.g. 20 feet or more) which are prone to warping under the heated environment within the fan shroud through which such long shafts must extend to reach the gear box beneath the fan hub. In the illustrated embodiment, motor shaft 145 has a length less substantially than the length of the motor and does not penetrate the fan shroud 133 in contrast to past motor shaft designs.

Although locating the fan motor 140 within the fan shroud 133 substantially and advantageously shortens the motor shaft, this also places the motor directly into the heated rising airstream from the interior space 116 of IDACC 100 at the intake of the fan 130, as previously described herein. This placement is detrimental to operational reliability and longevity of the motor and its drive shaft. To compensate, provisions are disclosed to both protect and cool the motor within this heated environment.

Figure 6:
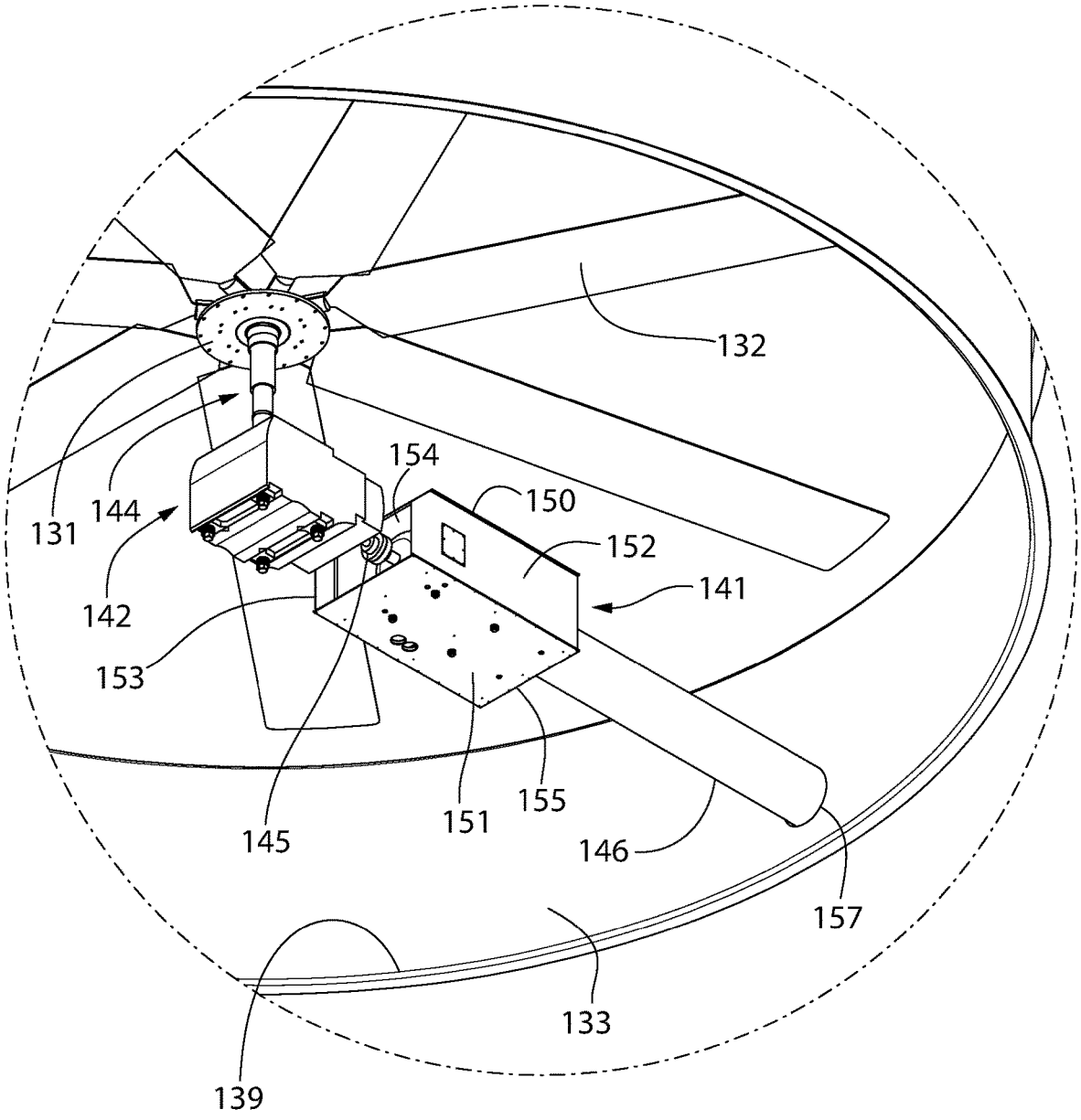
FIG. 6 is an enlarged detail from FIG. 5.

In one aspect to protect the fan motor 140, the motor is placed in a metallic protective enclosure 141 surrounding the motor which prevents the rising airstream from interior space 116 of IDACC 100 induced by fan 130 from directly impinging the motor (see, e.g. FIGS. 6, 13, and 17 et al.). The enclosure 141 is supported by the fan bridge 135 on mounting base 141*a* of the motor. In some preferred embodiments, protective enclosure 141 further comprises insulation 145 formed an insulated box-like structure of rectangular cuboid configuration in one embodiment to protect the motor. Other shaped enclosures may be used.

Protective enclosure 141 comprises a horizontal closed top wall 150, opposing horizontal closed bottom wall 151, and a pair of vertical closed lateral walls 152 extending between the top and bottom walls. Each of these walls is insulated. Enclosure 141 further comprises an at least partially open inner end 153 which defines an air outlet 154 facing inwards towards the fan 130, and an air inlet 156 formed in an opposite outer end wall 155. Accordingly, inner end 153 is open directly to the interior space 116 of the IDACC. Preferably insulated outer end wall 155 is closed except for a circular opening which defines air inlet 156.

To draw cool ambient air through the protective enclosure 141 which has not passed through and been heated by the tube bundles 112, a motor cooling system comprises an air inlet duct 146 coupled to the air inlet 156 of the enclosures. Air inlet duct 146 is fluidly coupled between the air inlet 156 of the enclosure at one inner end 146*a* and an air inlet opening 157 in the fan shroud 133 at an opposite outer end 146*b*. In some embodiments, the air inlet duct may extend through opening 157 and project outwards beyond the shroud 133 for a short distance forming a cantilevered extension portion 148 (see, e.g. FIG. 17 et al.). Air inlet duct 146 is metal and may have a circular cross-sectional shape as shown; however, other cross-sectional shapes may be used. It bears noting that air inlet duct allows ambient cooling air to bypass the tube bundles 112 and be directly drawn through protective motor enclosure interior 140*a* to cool the motor 140 housed therein. For optimum cooling of the motor, air inlet duct 146 may be insulated to prevent the cooling air from being preheated by the rising air in interior space 116 of IDACC 100 before reaching the motor.

Any suitable type and form of standard commercially-available insulation may be used for insulating protective enclosure 141 and air inlet duct 146. Some non-limiting examples include mineral wool, fiberglass, Styrofoam, etc.

The air inlet duct 146 is configured and operable to draw cool ambient air through the motor protective enclosure 141 via a vacuum formed by the fan 130 at the open air outlet 154 of the enclosure which faces the gear box 142 and vertical fan drive shaft 144. In operation, the rotating fan blades 132 of the axial flow fan 130 draws ambient air through the tube bundles 112 into interior space 116. The air is heated by the condensing steam inside the tubes 114 by as much as 70 degrees Fahrenheit or more as it flows into the interior space. Fan 130 draws suction from the interior space 116 located directly below, thereby creating a vacuum (negative pressure) therein. The interior 140*a* of the motor protective enclosure 141 is exposed to the vacuum at the open air outlet 154 at the inner end 153 of the enclosure. This vacuum draws ambient cooling air outside of the fan shroud 133 in a flow path through air inlet duct 146, interior 140*a* of enclosure 141, and outwards from air outlet 154 into interior space 116 of IDACC 100 directly beneath the fan 130 via a siphon effect. The air pressure inside the fan shroud 133 is lower than atmospheric air pressure outside the shroud, thereby causing the ambient air to be drawn inwards through the duct 146 and motor protective enclosure 141. The air inlet duct 146 thus acts as a snorkel to draw cooling air inwards past the motor towards the fan interior space 116 and space beneath the fan 130. As long as the fan is operating, the cooling air will continuously flow in the one-way flow path to keep the motor at a low enough temperature to avoid operational problems and damage despite the heated environment in which it is located (see, e.g. air flow directional flow arrows in FIG. 13).

In certain situations, it is foreseeable that the vacuum-driven or siphon cooling air flow rate may not be sufficient to cool the fan motor 140 adequately. This may occur where the air temperature of the IDACC interior space 116 is simply too high, or where the ambient air temperature is too high such as during summer months in more northern climates and/or in warmer climates most of the year. In such situations, a powered air booster fan 160 may optionally be provided which pressurizes and blows the ambient cooling air through the air inlet duct 146. Booster fan 160 is represented schematically in FIG. 13 by the dashed box at the inlet end of the air inlet duct 146. Any type of commercially-available electric fan or blower may be used such as without limitation the inline axial flow fan depicted, a centrifugal fan/blower, or other. The booster fan 160 increases the cooling air flow rate to the motor to keep it cool. In certain climates, the booster fan 160 might only be needed for operation during the short hotter summer months.

The pressure retention related components (e.g. headers, tubes and fins, etc.), fan and its appurtenances, and structural elements described herein may preferably be made of appropriate metallic materials suitable for the service conditions encountered.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. An induced draft air-cooled condenser comprising:

a vertical centerline axis;

a support structure;

a pair of inclined tube bundles supported by the support structure, the tube bundles each comprising a plurality of tubes;

the tube bundles defining an interior space in fluid communication with ambient air through the tube bundles;

a fan supported above the interior space along the vertical centerline axis, the fan comprising fan blades disposed inside an annular fan shroud; and a drive mechanism operable to rotate the fan blades, the drive mechanism comprising a motor coupled to the fan blades and located inside the fan shroud;

wherein the fan is operable to draw ambient air through tube bundles into the interior space;

wherein the fan and motor are mounted to and supported by a horizontal planar fan bridge spanning across and over the interior space inside the fan shroud, the fan bridge configured and structured to provide support for personnel to access the fan and motor;

wherein the fan bridge is supported at its ends by a horizontal planar peripheral fan deck disposed outside and extending circumferentially around the fan shroud, the peripheral fan deck supporting the fan shroud at a circular central airflow opening defined by the peripheral fan deck;

wherein the fan shroud comprises an access opening aligned with the fan bridge and arranged to allow personnel to access the fan bridge directly through the fan shroud.

2. The induced draft air-cooled condenser according to claim 1, wherein the central airflow opening is in fluid communication with the interior space.

3. The induced draft air-cooled condenser according to claim 2, wherein when the induced draft air-cooled condenser is in operation, air inside the interior space between the tube bundles has a higher temperature than the ambient air outside the tube bundles.

4. The induced draft air-cooled condenser according to claim 1, wherein the motor is disposed inside a protective enclosure.

5. The induced draft air-cooled condenser according to claim 4, wherein the protective enclosure is insulated.

6. The induced draft air-cooled condenser according to claim 5, wherein the protective enclosure comprises an air outlet facing the fan at one end, and an air inlet at an opposite end, the air inlet fluidly coupled to ambient air outside the fan shroud.

7. The induced draft air-cooled condenser according to claim 6, further comprising an air inlet duct fluidly coupled between the air inlet of the protective enclosure and an air inlet opening in the fan shroud.

8. The induced draft air-cooled condenser according to claim 7, wherein the air inlet duct is configured to draw ambient air through the motor enclosure via a vacuum formed by the fan at the air outlet of the protective enclosure.

9. The induced draft air-cooled condenser according to claim 8, wherein the air inlet duct projects through and outwards beyond the fan shroud.

10. The induced draft air-cooled condenser according to claim 9, further comprising a booster fan fluidly coupled to an inlet end of the air inlet duct outside the fan shroud.

11. The induced draft air-cooled condenser according to claim 4, wherein the motor enclosure further comprises a closed top wall, a closed bottom wall, and pair of closed lateral walls extending between the top and bottom walls.

12. The induced draft air-cooled condenser according to claim 11, wherein the motor enclosure has a rectangular cuboid configuration.

13. The induced draft air-cooled condenser according to claim 1, wherein a motor shaft which operably couples the motor to the fan has a length less than an inside diameter of the fan shroud.

14. The induced draft air-cooled condenser according to claim 1, wherein the motor is located closer to the vertical centerline axis of the air-cooled condenser than the fan shroud.

15. The induced draft air-cooled condenser according to claim 13, further comprising a gear box comprising a gear train coupled to the motor shaft and a fan drive shaft coupled to a hub supporting the fan blades, the gear train when driven by the motor operable to rotate the fan.

16. The induced draft air-cooled condenser according to claim 15, wherein the motor is located proximate to the gear box which is positioned beneath the fan hub on the vertical centerline axis of the air-cooled condenser.

17. The air-cooled condenser according to claim 1, wherein the fan is an axial flow fan.

18. The air-cooled condenser according to claim 1, wherein the fan bridge includes a laterally-widened central portion which supports the fan and motor.

19. An induced draft air-cooled condenser comprising:

a vertical centerline axis;

a support structure;

a pair of inclined tube bundles supported by the support structure, the tube bundles each comprising a plurality of tubes;

the tube bundles defining an interior space in fluid communication with ambient air through the tube bundles;

a fan supported above the interior space along the vertical centerline axis, the fan comprising fan blades disposed inside an annular fan shroud; and a drive mechanism operable to rotate the fan blades, the drive mechanism comprising a motor coupled to the fan blades and located inside the fan shroud;

wherein the fan is operable to draw ambient air through tube bundles into the interior space;

wherein the fan and motor are mounted to and supported by a horizontal planar fan bridge spanning across and over the interior space inside the fan shroud, the fan bridge configured and structured to provide support for personnel to access the fan and motor;

wherein the fan bridge is supported at its ends by a horizontal planar peripheral fan deck disposed outside and extending circumferentially around the fan shroud, the peripheral fan deck supporting the fan shroud at a circular central airflow opening defined by the peripheral fan deck;

wherein the fan bridge includes a laterally-widened central portion which supports the fan and motor.

* * * * *